United States Patent [19]

Hill

[11] 4,452,018

[45] Jun. 5, 1984

[54] DEVICE FOR ANCHORING A BUILDING

[76] Inventor: Claud A. Hill, 2706 E. Contention Mine Rd., Phoenix, Ariz. 85034

[21] Appl. No.: 366,771

[22] Filed: Apr. 8, 1982

Related U.S. Application Data

[62] Division of Ser. No. 165,143, Jul. 1, 1980, Pat. No. 4,342,179.

[51] Int. Cl.[3] ..... E02D 27/32; E02D 5/74

[52] U.S. Cl. ..... 52/155; 52/293

[58] Field of Search ..... 52/155, 293; 248/216.4, 248/547

[56] References Cited

U.S. PATENT DOCUMENTS

| | | | |
|---|---|---|---|
| 1,412,482 | 4/1922 | Vaile . | |
| 2,217,184 | 10/1940 | Rugg et al. . | |
| 2,297,058 | 9/1942 | Hasenburger et al. . | |
| 2,440,449 | 4/1948 | Raemer . | |
| 2,663,915 | 12/1953 | Dietrich . | |
| 2,835,017 | 5/1958 | Hoerr . | |
| 3,054,481 | 9/1962 | Johnson . | |
| 3,318,054 | 5/1967 | Giardina | 52/39 |
| 3,525,187 | 8/1970 | Vincent | 52/155 |
| 3,557,513 | 1/1971 | Girard | 52/629 |
| 4,342,179 | 8/1982 | Hill | 52/155 |

FOREIGN PATENT DOCUMENTS

| | | |
|---|---|---|
| 2202131 | 1/1972 | Fed. Rep. of Germany . |
| 327757 | 4/1930 | United Kingdom . |
| 1037550 | 7/1966 | United Kingdom . |

*Primary Examiner*—Alfred C. Perham

*Attorney, Agent, or Firm*—Warren F. B. Lindsley

[57] ABSTRACT

A device for anchoring a frame supporting rail to a construction site comprising a clamp for surrounding at least a part of the exposed surface of the rail wherein the clamp comprises at least one foot extending laterally outwardly of the base of the rail at its ground engaging surface. A hollow collar is attachable to the foot at an angular relationship to the rail and a spike is positioned longitudinally through the hollow interior of the collar and when driven into the construction site, anchors the rail thereto.

2 Claims, 11 Drawing Figures

DEVICE FOR ANCHORING A BUILDING

BACKGROUND OF THE INVENTION

This application is a division of U.S. patent application, Ser. No. 165,143, filed July 1, 1980, now U.S. Pat. No. 4,342,179, and entitled DEVICE FOR ANCHORING A BUILDING, by the same inventor.

It is common practice to purchase prefabricated houses, metal buildings, sheds and the like and assemble them on a prepared site. One of the problems encountered, however, is the need for anchoring the building to the ground or suitable supporting platform at the site in a simple and inexpensive manner.

Most of the prefabricated buildings have been anchored to the ground or platform in any haphazard manner devised by the party assembling the building.

Little or no thought has been given heretofore to providing an integral anchoring device forming a part of the framework of the building for anchoring the building to a supporting platform.

DESCRIPTION OF THE PRIOR ART

One known practice of the prior art is to spike the site engaging rail of the framework of the building to the supporting platform, or to fasten a clamp to the rail and then bolt the clamp to the supporting platform.

Other prior art cited in the parent application, Ser. No. 165,143, comprises the following patents: U.S. Pat. Nos. 3,054,481; 2,835,017; 2,297,058; 2,217,184; 1,412,582; 2,440,449; 2,663,915; 3,525,187; 3,318,054; 3,557,513; West German Pat. No. 2,202,131; British Pat. Nos. 327,757 and 1,037,550.

SUMMARY OF THE INVENTION

In accordance with the invention claimed, a new and improved device is disclosed for anchoring a frame supporting rail to a construction site and/or platform mounted on the site.

It is, therefore, one object of this invention to provide a new and improved anchoring device for the ground supporting rail of a building.

Another object of this invention is to provide a modified I-beam rail forming the ground supporting rail of a building which employs spiking means extending through the base of the I-beam for attaching it to its supporting platform.

A further object of this invention is to provide a modified I-beam ground supporting rail for buildings in which a spiking means is formed integral therewith.

A still further object of this invention is to provide a clamp which at least partially surrounds the ground engaging leg of an I-beam supporting rail for a building which has formed integral therewith collars for receiving spiking means spacedly arranged along its length.

These and other objects and advantages of this invention will become more apparent as the description proceeds and the features of novelty which characterize this invention will be pointed out with particularity in the claims annexed to and forming part of the specification.

BRIEF DESCRIPTION OF THE DRAWING

The present invention may be more readily described by reference to the accompanying drawing, in which.

DESCRIPTION OF THE PREFERRED EMBODIMENT

Figure 1:
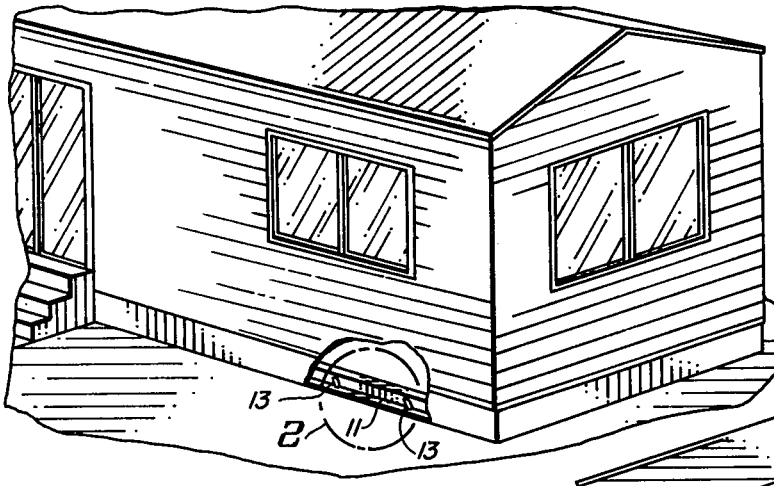
FIG. 1 is a perspective view of a representative building employing a ground supporting rail embodying the invention.

Referring more particularly to the drawing by characters of reference, FIG. 1 discloses a building 10 which is representative of any building or shed, prefabricated or not, which employs as part of its framework ground supporting rail 11. This rail not only forms an integral part of the framework, but also is the part of the building which is attached to the building supporting platform or ground 12. Heretofore, clamps were attached to the ground supporting rails; or spikes were driven through the rail, if wood was used, into the platform. In most cases, the carpenter assembling the building used any fixtures at hand to accomplish the task.

Figure 2:
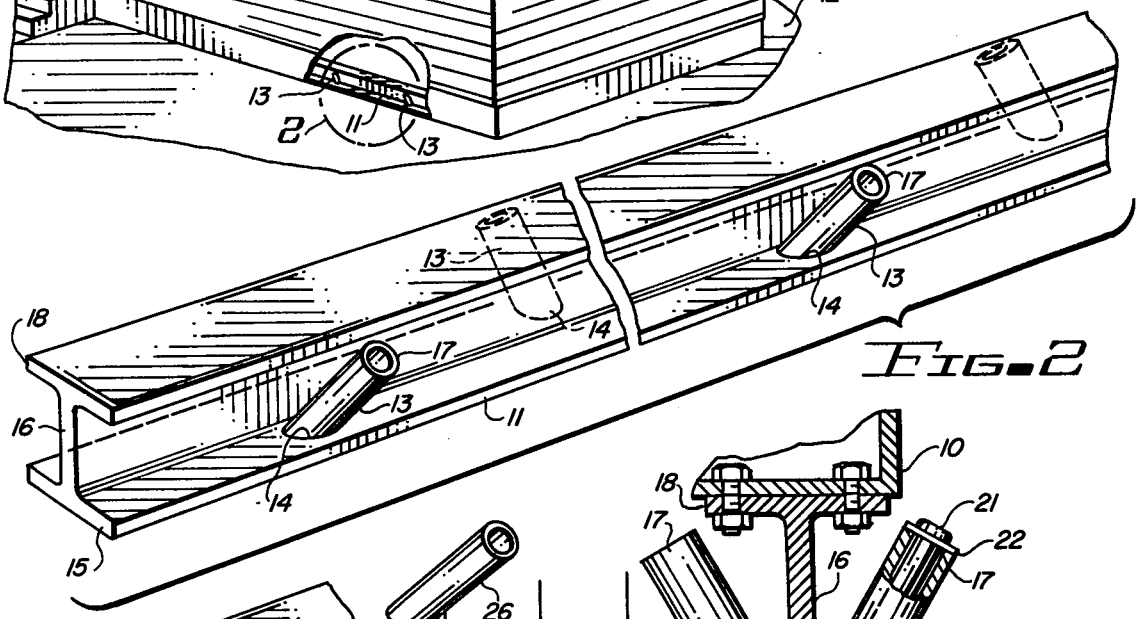
FIG. 2 is an enlargement of the circled portion given the reference character 2 in FIG. 1.

In order to provide a simple and effective anchoring means for buildings, and particularly prefabricated buildings employing ground supporting rails such as I-beam 11 shown in FIGS. 1 and 2, an anchoring means is provided. This anchoring means comprises a sleeve or collar 13, the rail engaging end 14 of which is tapered or cut laterally to the longitudinal axis of the collar so that it will engage the bottom leg 15 of the I-beam 11 at an angle to the vertical web 16 of the I-beam, as shown in FIG. 2.

Figure 3:
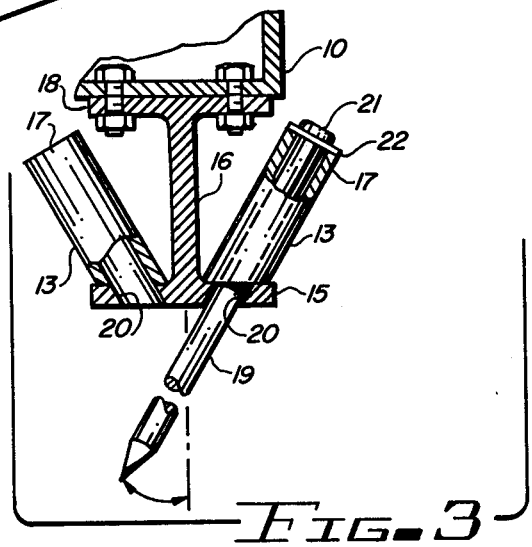
FIG. 3 is an enlarged perspective view partially broken away of a portion of the ground supporting rail shown in FIGS. 1 and 2 and illustrating the ground supporting spike in position.

This angle of collar 13 with web 16 of the I-beam 11 should be such that the open end 17 of collar 13 extends outwardly of the top leg 18 of I-beam 11 so that it may receive therein a suitable spike 19, as shown in FIG. 3.

It should be noted that the I-beam 11 may be provided with apertures 20 spacedly arranged in its leg 15 along its length on each side of web 16 thereof, or these apertures or holes may be drilled therein by the carpenter or laborer assembling the building.

Thus, after the rails or I-beams 11 are assembled on the supporting surface or platform 12 for the building, the laborer fastens the I-beam to the platform at selected positions. This is accomplished by angularly positioning the collars 13 over the apertures or holes 20 in the angular arrangement shown in FIGS. 2 and 3. Spike 19 is then placed therein and driven into the supporting platform until its head 21 engages end 17 of collar 13. A washer 22 may be positioned between head 21 of spike 19 and the end 17 of collar 13, as shown in FIG. 3, if so desired.

Figure 5:
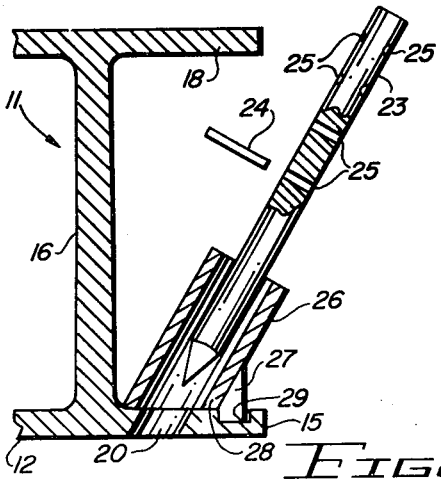
FIG. 5 is a cross-sectional view of FIG. 4 taken along the lines 5—5.

As shown in FIG. 5, collar 13 of FIGS. 1–3 may be of any suitable length and the associated spike 23 is selectively driven through the collar into a supporting platform 12 to any depth which is controlled by a nail or pin 24 driven laterally through holes 25 in the spike at any one of a number of positions along its length.

Figure 4:
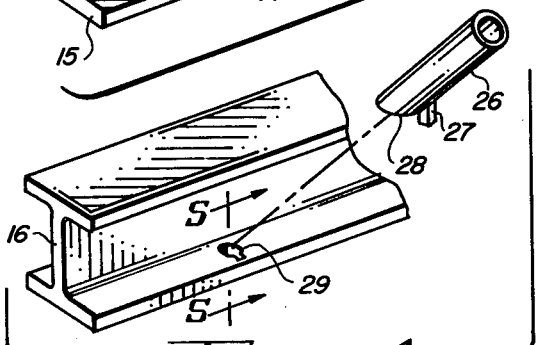
FIG. 4 is a perspective exploded partial view of a modification of the rail anchoring means shown in FIGS. 1-3.

In FIGS. 4 and 5, the anchoring means comprises a collar 26 employing a leg 27 extending outwardly of its periphery at end 28 thereof for indexing and interlocking with an aperture or notch 29 formed in the top surface of leg 15 of the I-beam. In this manner, each collar is properly angularly positioned with reference to web 16 of the I-beam and firmly held in place before the spikes are driven through the collar and into the supporting platform.

Figure 6:
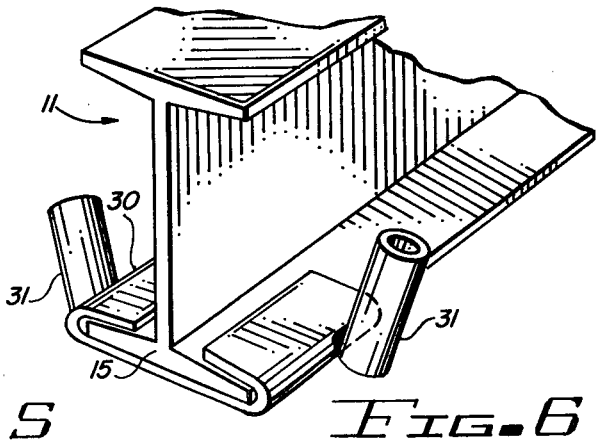
FIG. 6 is a modification of the anchoring means shown in FIGS. 1-5.

FIG. 6 discloses a further modification of the anchoring means wherein it comprises a clamp 30 fitting around and clamping over the edges of leg 15 of the I-beam 11 with collars 31 formed integral therewith at the ends of the clamp, as shown. These collars may be spot welded to the clamps at any suitable angular position to fit the builder's needs. Spikes of the type shown by FIGS. 3 and 5 may be used.

It should be noted as falling within the scope of this invention that the collars 13 may be fitted to the I-beams and welded thereto prior to the I-beam use in assembling the buildings.

FIGS. 7 through 11 illustrate still further modifications of the rail anchoring means shown in FIGS. 1–6.

Figure 7:
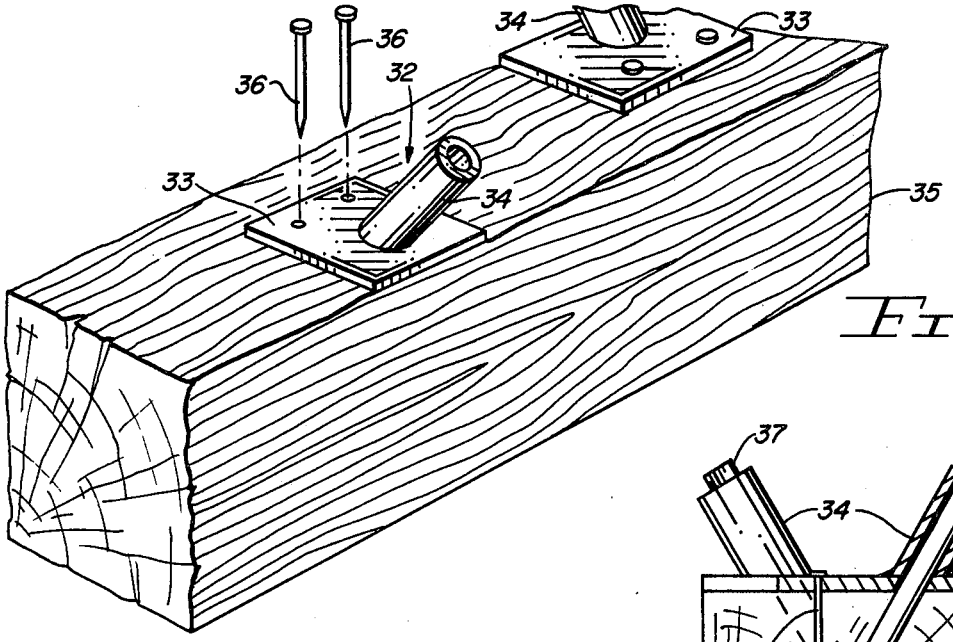
FIG. 7 is a modification of the rail anchoring means shown in FIGS. 1-6 wherein an elongated spike receiving collar is mounted on a plate.

In FIG. 7, a rail anchoring means 32 is illustrated comprising a flat plate 33 having a collar 34 secured thereto in an angular relationship by welding or other means in a manner similar to the angular arrangement of the collars 13, 26 and 31 shown in FIGS. 1–6. Plate 33 is nailed or bolted to rail 35, formed in this instance of lumber of any suitable cross-sectional size, by suitable means 36.

Figure 8:
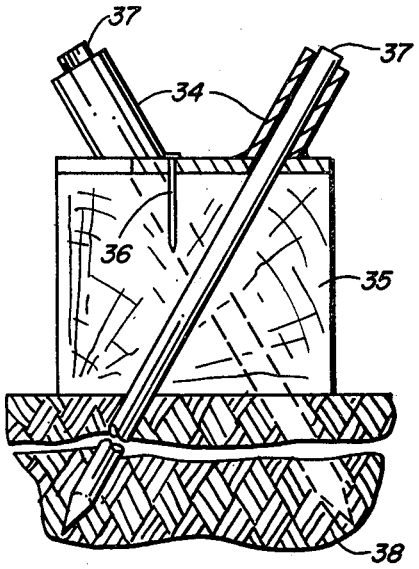
FIG. 8 is a cross-sectional view partially in elevation showing the anchoring plates of FIG. 7 in use.

As shown in FIG. 8, suitable spikes 37 are used to fasten the rail to a supporting platform 38.

Figure 9:
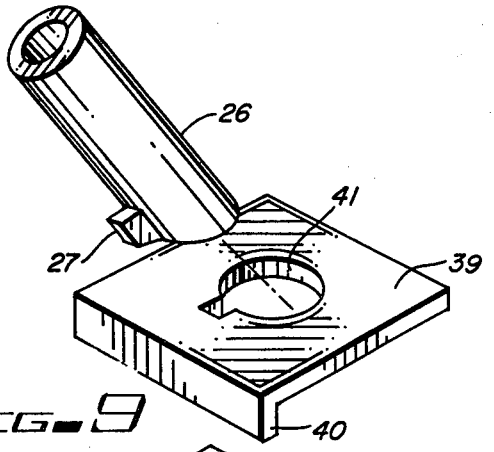
FIG. 9 is a modification of the rail anchoring means shown in FIGS. 7 and 8 wherein the spike receiving collar is detachably interlocked with its mounting plate.

FIG. 9 illustrates a modification of the rail anchoring means shown in FIGS. 7 and 8 wherein plate 39 is provided with a flange 40 which fits over the edge of rail 35 to hold the plate in a given position. A collar 26 with its anchoring or indexing leg 27 is interlockable with an aperture 41 therein in the same manner as shown in FIG. 5.

Figure 10:
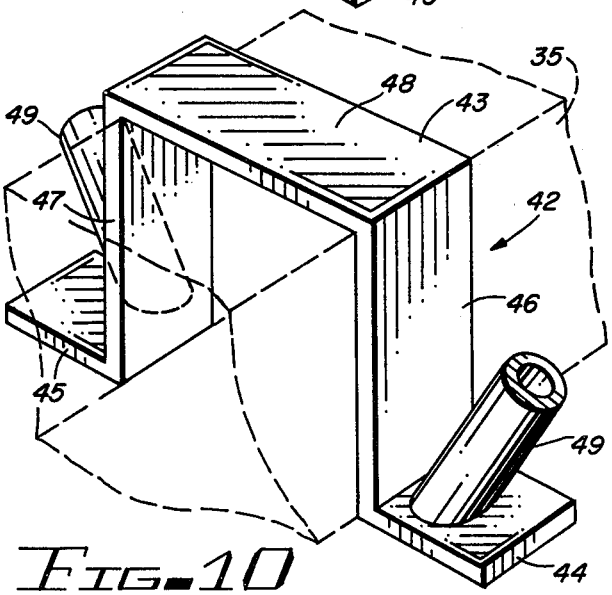
FIG. 10 illustrates a further modification of the rail anchoring means shown in FIGS. 1-9 employing a rail engaging clamp.

FIG. 10 illustrates a still further modification of the rail anchoring means shown in FIGS. 1–9 wherein the rail anchoring means 42 comprises a U-shaped clamp 43 having a pair of flanges 44 and 45 extending outwardly of its legs 46 and 47, respectively, in a plane parallel with the bight 48 of the U-shaped configuration. Collars 49 are suitably attached to the flanges 44 and 45 in an angular arrangement similar to those shown in FIGS. 1–9.

Figure 11:
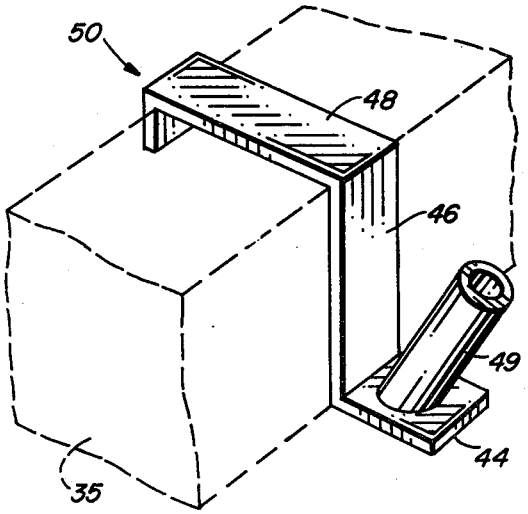
FIG. 11 is a modification of the clamp shown in FIG. 10.

FIG. 11 illustrates a modification of the clamp shown in FIG. 10 wherein clamp 50 comprises a portion of the U-shaped configuration 43 shown in FIG. 10 which clamps over rail 35 in the manner shown.

It will be apparent to those skilled in the art that changes and other modifications may be made to the apparatus shown and described herein without departing from the scope of the appended claims.

What is claimed is:

1. A device for anchoring the ground engaging surface of a frame supporting rail to a construction site comprising:

clamp means for surrounding at least a part of the exposed surface of the ground engaging rail, said clamp means comprising a first foot extending laterally outwardly of one side of the base of said rail at its ground engaging surface, a first aperture arranged to extend through said first foot, a first elongated hollow collar, and a first means for attaching one end of said first collar over said first aperture to assume an angular relationship with the longitudinal axis of said rail, said first means for attaching said first collar to said rail further comprising an indexing means in said first foot for positioning said first collar relative to said rail, said angular relationship spacing the other end of said first collar at a predetermined distance from the top of said rail.

2. A device for anchoring the ground engaging surface of a frame supporting rail to a construction site comprising:

clamp means for surrounding at least a part of the exposed surface of the ground engaging rail, said clamp means comprising a first foot extending laterally outwardly of one side of the base of said rail at its ground engaging surface, a first aperture arranged to extend through said first foot, a first elongated hollow collar, a first means for attaching one end of said first collar over said first aperture to assume an angular relationship with the longitudinal axis of said rail, said angular relationship spacing the other end of said first collar at a predetermined distance from the top of said rail, said clamp means comprising a second foot extending laterally outwardly of the opposite side of the base of said rail from said first foot, a second aperture arranged to extend through said second foot, a second elongated hollow collar, and second means for attaching one end of said second collar over said second aperture to assume an angular relationship with the longitudinal axis of said rail, said first and second means for attaching said first and second collars to the rail each further comprising an indexing means in the associated foot for positioning said first and second collars relative to the rail.

* * * * *